US009680228B2

(12) United States Patent
Park et al.

(10) Patent No.: US 9,680,228 B2
(45) Date of Patent: Jun. 13, 2017

(54) ANTENNA APPARATUS AND ELECTRONIC DEVICE INCLUDING THE SAME

(71) Applicant: Samsung Electronics Co., Ltd., Suwon-si, Gyeonggi-do (KR)

(72) Inventors: Jungsik Park, Suwon-si (KR); Wangik Son, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 36 days.

(21) Appl. No.: 14/660,201

(22) Filed: Mar. 17, 2015

(65) Prior Publication Data

US 2015/0311595 A1 Oct. 29, 2015

(30) Foreign Application Priority Data

Apr. 28, 2014 (KR) ..... 10-2014-0050444

(51) Int. Cl.

| | |
|---|---|
| ***H01Q 1/24*** | (2006.01) |
| ***H01Q 13/10*** | (2006.01) |
| ***H01Q 1/42*** | (2006.01) |
| ***H01Q 1/44*** | (2006.01) |

(52) U.S. Cl.

CPC ..... *H01Q 13/10* (2013.01); *H01Q 1/241* (2013.01); *H01Q 1/243* (2013.01); *H01Q 1/42* (2013.01); *H01Q 1/44* (2013.01)

(58) Field of Classification Search

CPC ..... H01Q 1/24; H01Q 1/241; H01Q 1/243; H01Q 13/10

USPC ..... 343/702, 767, 770

See application file for complete search history.

(56) References Cited

U.S. PATENT DOCUMENTS

| | | | | |
|---|---|---|---|---|
| 7,161,548 | B2 * | 1/2007 | Tsukamoto | H01Q 13/10 343/702 |
| 7,391,378 | B2 | 6/2008 | Mikkola et al. | |
| 7,936,307 | B2 | 5/2011 | Pang et al. | |
| 8,026,856 | B2 * | 9/2011 | Yang | H01Q 1/243 343/702 |
| 8,090,423 | B2 | 1/2012 | Na et al. | |
| 8,134,507 | B2 | 3/2012 | Chen et al. | |
| 8,270,914 | B2 | 9/2012 | Pascolini et al. | |
| 8,441,404 | B2 * | 5/2013 | Chiang | H01Q 13/08 343/770 |
| 2012/0175165 | A1 | 7/2012 | Merz et al. | |
| 2012/0262357 | A1 | 10/2012 | Kato et al. | |
| 2014/0184450 | A1 * | 7/2014 | Koo | H01Q 5/335 343/702 |

* cited by examiner

*Primary Examiner* — Hoang Nguyen

(74) *Attorney, Agent, or Firm* — Jefferson IP Law, LLP

(57) ABSTRACT

An antenna apparatus is provided. The antenna apparatus includes a first section including at least one slit spaced apart from an outer edge of the antenna apparatus by a predetermined distance, a second section distinguished from the first section through the slit, and a feeding module for supplying a current to at least one of the first section and the second section.

18 Claims, 11 Drawing Sheets

ANTENNA APPARATUS AND ELECTRONIC DEVICE INCLUDING THE SAME

CROSS-REFERENCE TO RELATED APPLICATION(S)

This application claims the benefit under 35 U.S.C. §119 (a) of a Korean patent application filed on Apr. 28, 2014 in the Korean Intellectual Property Office and assigned Serial number 10-2014-0050444, the entire disclosure of which is hereby incorporated by reference.

TECHNICAL FIELD

The present disclosure relates to an antenna apparatus and an electronic device including the same. More particularly, the present disclosure relates to an antenna apparatus incorporating a component of the electronic device as part of the antenna.

BACKGROUND

Electronic devices may provide various functions and programs, and some electronic devices such as smartphones or tablet computers may acquire various types of information from outside the electronic device using wireless communications. The information acquired by the electronic devices using wireless communications may be transmitted or received, for example, by using electromagnetic waves, and therefore the electronic device may include at least one antenna. For example, the kinds of antennas provided in the electronic device may be determined according to at least one of a network, a service, an area, and a purpose thereof.

Such an electronic device may include various component elements. The electronic device may include, for example, a circuit component, a case, a substrate, and an input/output module as component elements of the electronic device. For example, the component elements included in the electronic device may be formed by using a conductive material such as metal or a nonconductive material such as plastic.

The transmission/reception performance of electromagnetic waves of an antenna may vary, for example, according to a distance between an antenna and another component element formed of metal, or according to a size (for example, a volume) of the antenna.

The above information is presented as background information only to assist with an understanding of the present disclosure. No determination has been made, and no assertion is made, as to whether any of the above might be applicable as prior art with regard to the present disclosure.

SUMMARY

According to related art, as the size of an electronic device decreases and the number of functions provided by the electronic device increases, a space for mounting an antenna becomes smaller in the electronic device. Further, various types of antenna apparatuses should be accommodated in a limited space of an electronic device.

In addition, because various component elements of an electronic device are formed of a conductive material such as metal, the transmission/reception performance of an antenna may deteriorate due to the component elements.

Aspects of the present disclosure are to address at least the above-mentioned problems and/or disadvantages and to provide at least the advantages described below. Accordingly, an aspect of the present disclosure is to provide an antenna apparatus and an electronic device including the same.

An aspect of the present disclosure is to provide a space for mounting an antenna apparatus, for example, by using at least one of the component elements of an electronic device as a portion of an antenna apparatus.

Another aspect of the present disclosure is to provide an antenna apparatus by which a radiation performance of an electronic device can be secured without increasing the volume of the antenna apparatus, and an electronic device including the same.

In accordance with an aspect of the present disclosure, an antenna apparatus is provided. The antenna includes a first section including at least one slit spaced apart from an outer edge of the antenna apparatus by a specified distance, a second section distinguished from the first section through the slit, and a feeding module for supplying a current to at least one of the first section and the second section.

In accordance with another aspect of the present disclosure, an electronic device is provided. The electronic device includes a circuit board, and an antenna to which electric power is fed through the circuit board, and the antenna includes a first section comprising a slit spaced apart from an outer edge of the electronic device by a specified distance, a second section distinguished from the first section through the slit, and a feeding module for supplying a current to at least one of the first section and the second section from the circuit board, wherein at least a portion of the first section is formed of a conductive material.

According to the antenna apparatus and the electronic device of the present disclosure, a spatial restriction for an antenna can be improved by using a component element of the electronic device as a portion of the antenna. In addition, according to the antenna apparatus and the electronic device of the present disclosure, manufacturing costs of the electronic device can be reduced and a design of the electronic device can be made appealing by using a component element of the electronic device as a portion of the antenna.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description in conjunction with the accompanying drawings, in which.

Throughout the drawings, it should be noted that like reference numbers are used to depict the same or similar elements, features, and structures.

DETAILED DESCRIPTION

Figure 1:
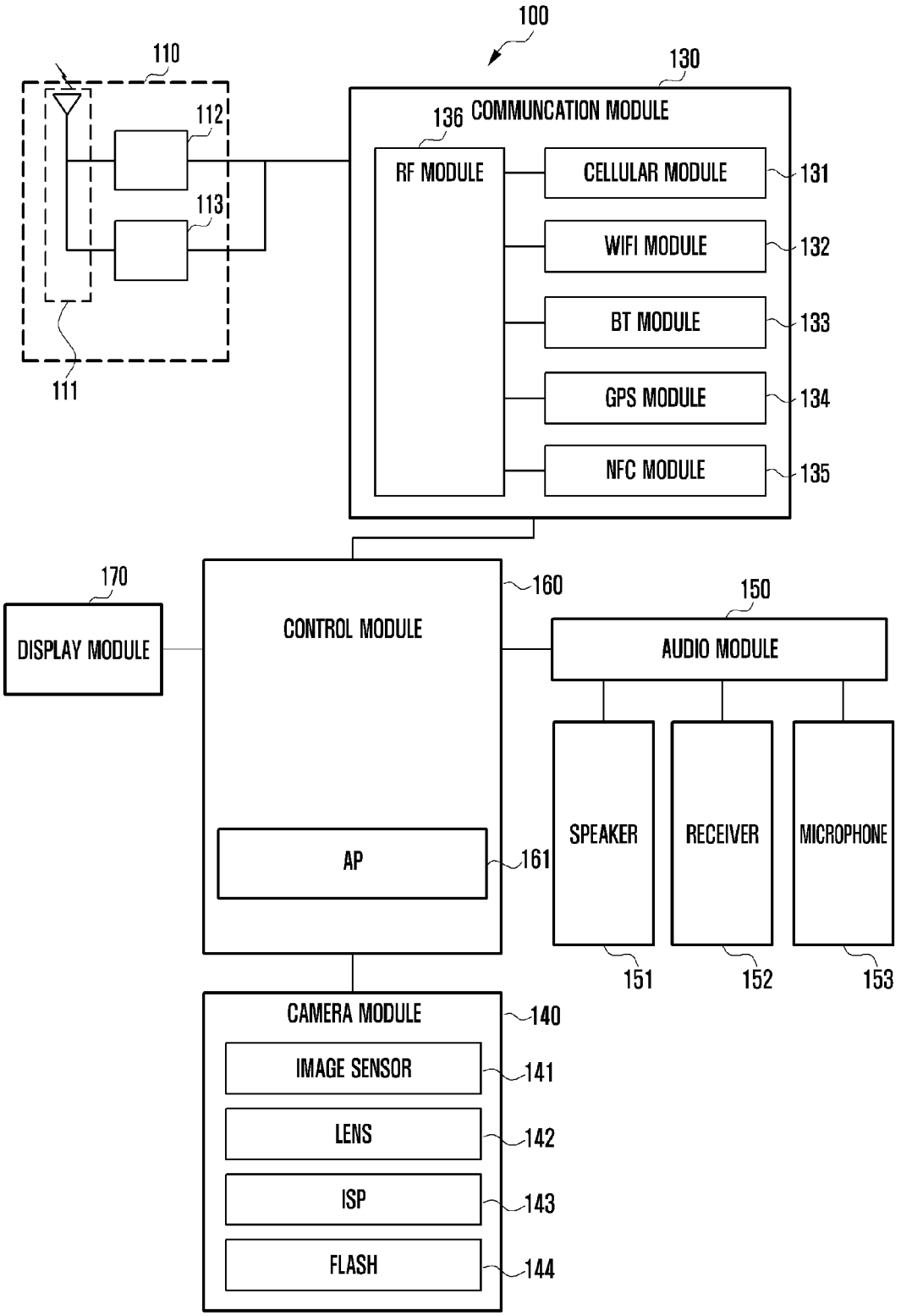
FIG. 1 is a block diagram of an electronic device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The expressions that may be used in various embodiments of the present disclosure, such as, "comprise", "may comprise," or the like, indicate the existence of a disclosed corresponding function, operation, component element, or the like, and may not limit additional one or more functions, operations, component elements or the like. Further, it should be understood that the terms "include" or "have" in various embodiments of the present disclosure refer to the presence of features, numbers, steps, operations, elements, or components, or a combination thereof, which are described in the specification, and do not rule out the presence or the addition of features, numbers, steps, operations, elements, or components, or a combination thereof.

In various embodiments of the present disclosure, the expression "or" or "at least one of A or/and B" includes any or all of combinations of words listed together. For example, the expressions "A or B" or "at least A or/and B" may include A, may include B, or may include both A and B.

The expressions "1," "2," "first," or "second" used in various embodiments of the present disclosure may modify various components of various embodiments but does not limit the corresponding components. For example, the above expressions do not limit the sequence and/or importance of the elements. The above expressions may be used merely for the purpose to distinguish a constituent element from other constituent elements. For example, a first user device and a second user device indicate different user devices although both of them are user devices. For example, without departing from the scope of the present disclosure, a first component element may be named a second component element. Similarly, the second component element also may be named the first component element.

When a component is referred to as being "connected" or "accessed" to any other component, it should be understood that the component may be directly connected or accessed to the other component, but another new component may also be interposed between them. Further, when a component is referred to as being "operatively coupled" or "operatively connected" to any other component, it should be understood that such expression includes the general and conventional meaning of the corresponding terms, and does not refer to a physical connection relation between components, but reflects a functional relation between components. Contrarily, when a component is referred to as being "directly connected" or "directly accessed" to any other component, it should be understood that there is no new component between the component and the other component.

In the present disclosure, the terms are used to describe an embodiment, and are not intended to limit the present disclosure. Singular forms are intended to include plural forms unless the context clearly indicates otherwise.

Unless defined differently, all terms used herein, which include technical terminologies or scientific terminologies, have the same meaning as that understood by a person skilled in the art to which the present disclosure belongs. Such terms as those defined in a generally used dictionary are to be interpreted to have the meanings equal to the contextual meanings in the relevant field of art, and are not to be interpreted to have ideal or excessively formal meanings unless clearly defined in the present specification.

An electronic device according to various embodiments of the present disclosure may be a device having an antenna. For example, the electronic device may include at least one of a smartphone, a tablet Personal Computer (PC), a mobile phone, a video phone, an electronic book (e-book) reader, a desktop PC, a laptop PC, a netbook computer, a Personal Digital Assistant (PDA), a Portable Multimedia Player (PMP), an MP3 player, a mobile medical appliance, a camera, and a wearable device (e.g. a Head-Mounted-Device (HMD) such as electronic glasses, electronic clothes, an electronic bracelet, an electronic necklace, an electronic accessory, electronic tattoos, or a smartwatch).

According to some embodiments, the electronic device may be a smart home appliance with an antenna. The smart home appliance as an example of the electronic device may include at least one of, for example, a television, a Digital Video Disk (DVD) player, an audio, a refrigerator, an air conditioner, a vacuum cleaner, an oven, a microwave oven, a washing machine, an air cleaner, a set-top box, a TV box (e.g., Samsung HomeSync™, Apple TV™, or Google TV™), a game console, an electronic dictionary, an electronic key, a camcorder, and an electronic picture frame.

According to another embodiment, the electronic devices may include at least one of various medical devices (e.g., a Magnetic Resonance Angiography (MRA), a Magnetic Resonance Imaging (MRI), a Computed Tomography (CT) machine, and an ultrasonic machine), navigation devices, Global Positioning System (GPS) receivers, Event Data Recorders (EDR), Flight Data Recorders (FDR), vehicle infotainment devices, electronic devices for ships (e.g., navigation devices for ships, and gyro-compasses), avionics, security devices, automotive head units, robots for home or industry, Automated Teller Machines (ATMs) in banks, or Point of Sales (POS) in shops.

According to another embodiment, the electronic devices may include at least one of furniture or a part of a building/structure having a communication function, electronic boards, electronic signature receiving devices, projectors, or various measuring equipment (e.g., equipment for a water supply, an electricity, gases or radio waves). An electronic device according to various embodiments of the present disclosure may be a combination of one or more of above described various devices. Also, an electronic device according to the present disclosure may be a flexible device. Also, an electronic device according to various embodiments of the present disclosure is not limited to the above-described devices.

Hereinafter, an electronic device according to various embodiments of the present disclosure will be described with reference to the accompanying drawings. The term "a user" used in various embodiments may refer to a person who uses electronic devices or a device (e.g., an artificial intelligence electronic device) that uses electronic devices.

FIG. 1 is a block diagram showing an electronic device 100 according to an embodiment of the present disclosure.

Referring to FIG. 1, the electronic device 100 may include an antenna apparatus 110, a communication module 130, a camera module 140, an audio module 150, a control module 160, and a display module 170.

According to an embodiment of the present disclosure, the antenna apparatus 110 may include at least one of a radiation module 111, a feeding module 112, and a ground connection module 113.

The radiation module 111 may covert a current supplied, for example, from the communication module 130 into an electromagnetic wave to radiate the electromagnetic wave to the outside. The radiation module 111 may convert the electromagnetic wave received from the outside into a current to transmit the current to the communication module 130.

For example, the feeding module 112 may be electrically connected to the radiation module 111. If the antenna apparatus 110 is coupled to (mounted to or engaged with) the electronic device 100, the feeding module 112 may electrically connect the radiation module 111 and the communication module 130. The coupling of the antenna apparatus 100 to the electronic device 100 may include a physical coupling or a functional coupling. At least a portion of the feeding module 112 may be located in a Printed Circuit Board (PCB) of the electronic device 100. For example, the feeding module 112 may include a circuit for impedance matching, mounted onto the PCB, and a wire for connection with the radiation module 111. The communication module 130 may supply a current to the feeding module 112. The feeding module 112 may forward a current received from the communication module 130 to the radiation module 111. Further, the feeding module 112 may forward a current received from the radiation module 111 to the communication module 130.

For example, the ground connection module 113 may be electrically connected to the radiation module 111. If the antenna apparatus 110 is coupled to the electronic device 100, the ground connection module 113 may electrically connect the radiation module 111 and the communication module 130. At least a portion of the ground connection module 113 may be located in the PCB of the electronic device 100. For example, the ground connection module 113 may include a circuit for impedance matching ("matching circuit"—not shown), mounted onto the PCB, and a wire for grounding of the PCB.

In the feeding module 112 or the ground connection module 113, the matching circuit may be electrically connected, for example, to the radiation module 111. For example, if the antenna apparatus 110 is coupled to the electronic device 100, the matching circuit may contact the ground of the PCB to electrically connect the radiation module 111 and the ground of the PCB. For example, the matching circuit may match impedance between the radiation module 111 and the feeding module 112. Further, for example, the matching circuit may match impedance between the radiation module 111 and the ground connection module 113. The matching circuit may include, for example, at least one circuit component. For example, the matching circuit may include at least one of a resistor, an inductor, and a capacitor as a lumped element. Further, for example, the matching circuit may include at least one of a micro strip line or a strip line as a distributed element.

According to an embodiment, the antenna apparatus 110 may include a connection module (for example, an electric wire) connecting the radiation module 111 to the ground of the electronic device 100.

The communication module 130 may transmit and receive data in a communication between the electronic device 100 and other electronic devices connected through a network. According to an embodiment, the communication module 130 may include a cellular module 131, a WiFi module 132, a Bluetooth (BT) module 133, a GPS module 134, a Near Field Communication (NFC) module 135, a Radio Frequency (RF) module 136, and an Application Process (AP) 161.

The cellular module 131 may provide a voice, a call, a video call, a Short Message Service (SMS), or an Internet service through a communication network (for example, Long Term Evolution (LTE), LTE-A, Code Division Multiple Access (CDMA), Wideband CDMA (WCDMA), Universal Mobile Telecommunication System (UMTS), Wireless Broadband (WiBro), or Global System for Mobile communication (GSM)). Furthermore, the cellular module 131 may distinguish and authenticate electronic devices within a communication network using a subscriber identification module (SIM) card. According to an embodiment, the cellular module 131 may perform at least a part of a function that may be provided by the AP 161. For example, the cellular module 131 may perform at least a part of a multimedia control function.

According to an embodiment, the cellular module 131 may include a Communication Processor (CP) (not shown). Furthermore, the cellular module 131 may be implemented by, for example, a System on a Chip (SoC). Although FIG. 1 shows that the cellular module 131 is a separate component element from the AP 161, it may be configured such that the AP 161 includes at least one (for example, the cellular module 131) of the above-described component elements.

According to an embodiment, the AP 161 or the cellular module 131 may load a command or data received from at least one of a non-volatile memory and other component elements connected thereto to a volatile memory and process the loaded command or data. Further, the AP 161 or the cellular module 131 may store data received from or generated by at least one of the other elements in a non-volatile memory.

The WiFi module 132, the BT module 133, the GPS module 134, or the NFC module 135 may include, for example, a processor for processing data transmitted and received through the corresponding module. Referring to FIG. 1, the cellular module 131, the WiFi module 132, the BT module 133, the GPS module 134, and the NFC module 135 are shown as separate blocks, but at least some (for example, two or more) of the cellular module 131, the WiFi module 132, the BT module 133, the GPS module 134, and the NFC module 135 may be included in one Integrated Chip (IC) or one IC package. For example, at least some (for example, the communication processor corresponding to the cellular module 131 and the WiFi processor corresponding to the WiFi module 132) of the processors corresponding to the cellular module 133, the WiFi module 134, the BT module 135, the GPS module 131, and the NFC module 132 may be implemented by one SoC.

According to an embodiment of the present disclosure, the antenna apparatus 110 according to the present disclosure may be an antenna for an NFC or a Radio Frequency Identification (RFID) communication. For example, a reader, a writer, and an NFC tag included in the NFC system may exchange information through a radio signal within a predetermined distance range. The antenna apparatus 110 may transmit and receive, for example, a radio signal of about 13.56 MHz, which is one of the frequencies used in an NFC communication as known in the art. However, various embodiment of the present disclosure is not limited thereto, but may be modified variously.

The RF module 136 may transmit and receive data, for example, RF signals. Although not shown, the RF module 136 may include, for example, a transceiver, a Power Amp Module (PAM), a frequency filter, and a Low Noise Amplifier (LNA). Although the cellular module 131, the WiFi module 132, the BT module 133, the GPS module 134, and the NFC module 135 share one RF module 829 in FIG. 1, at least one of the cellular module 136, the WiFi module 131, the BT module 132, the GPS module 133, and the NFC module 134 may transmit/receive an RF signal through a separate RF module in one embodiment.

The camera module 140 is a device for photographing a still image or a video, and according to an embodiment of the present disclosure, the camera module 140 may include at least one image sensor 141 (for example, a front sensor or a rear sensor), a lens 142, an Image Signal Processor (ISP) 143, and a flash 144 (for example, an LED or a xenon lamp).

The audio module 150 may convert a sound and an electrical signal in two directions. The audio module 150 may process sound information input or output, for example, through a speaker 151, a receiver 152, a microphone 153, or an earphone (not shown).

The control module 160 may control an overall operation of the electronic device 100 and a signal flow between internal modules of the electronic device 100, and may perform a data processing function for processing data. For example, the AP 161 may perform a data processing function for processing data.

The display module 170 may display various pieces of information (for example, multimedia data or text data).

The component elements of the electronic device 100 may include one or more components. The titles of the component elements may be changed according to the type of the electronic device. The electronic device 100 may include at least one of the above-described component elements, and some component elements may be omitted or an additional component element may be added. Further, some of the component elements of the electronic device 100 may be coupled to each other to configure one entity, so that the functions of the corresponding component elements before coupling may be performed in the same way.

The term "module" used in the present disclosure may refer to, for example, a unit including one or more combinations of hardware, software, and firmware. The term "module" may be interchangeable with a term, such as a unit, a logic, a logical block, a component, or a circuit. A "module" may be a minimum unit of an integrated component element or a part thereof. A "module" may be a minimum unit for performing one or more functions or a part thereof. A "module" may be mechanically or electronically implemented. For example, a "module" according to the present disclosure may include at least one of an Application-Specific Integrated Circuit (ASIC) chip, a Field-Programmable Gate Arrays (FPGA), and a programmable-logic device for performing operations which has been known or are to be developed hereinafter.

Figure 2A:
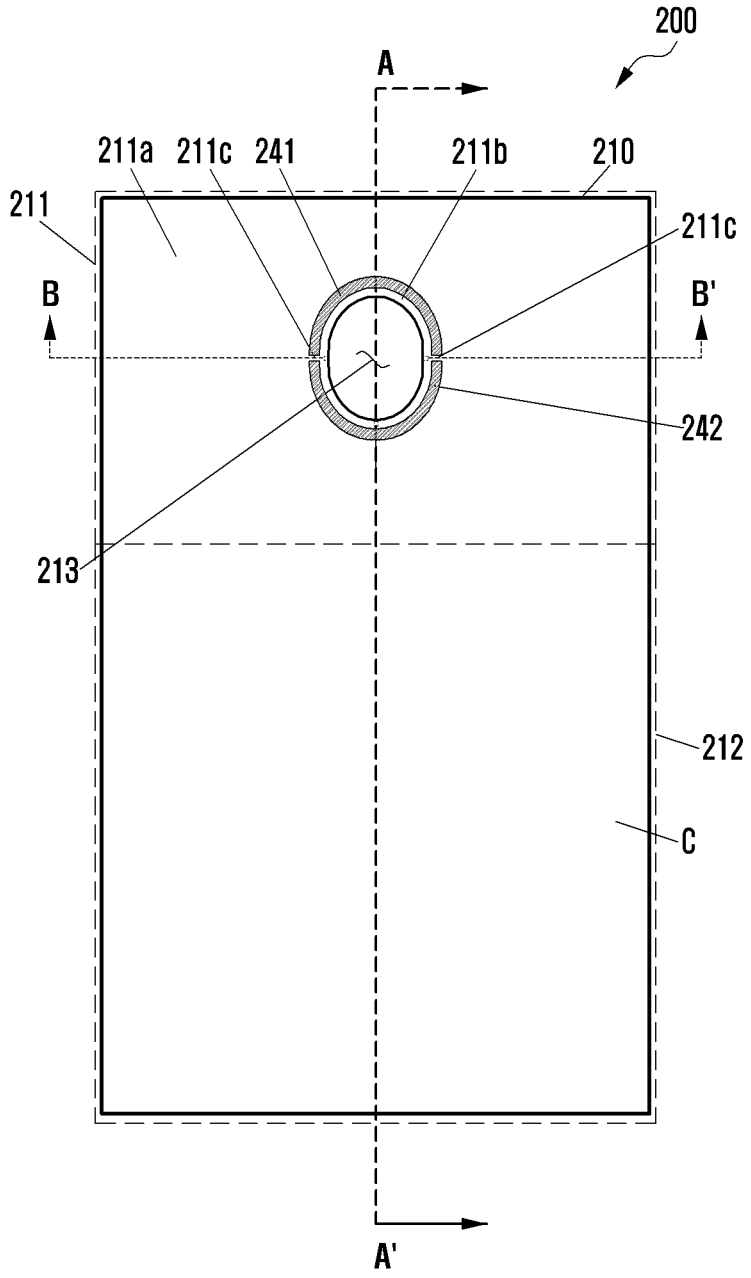
FIG. 2A is a front view of an antenna apparatus according to an embodiment of the present disclosure.
Figure 2B:
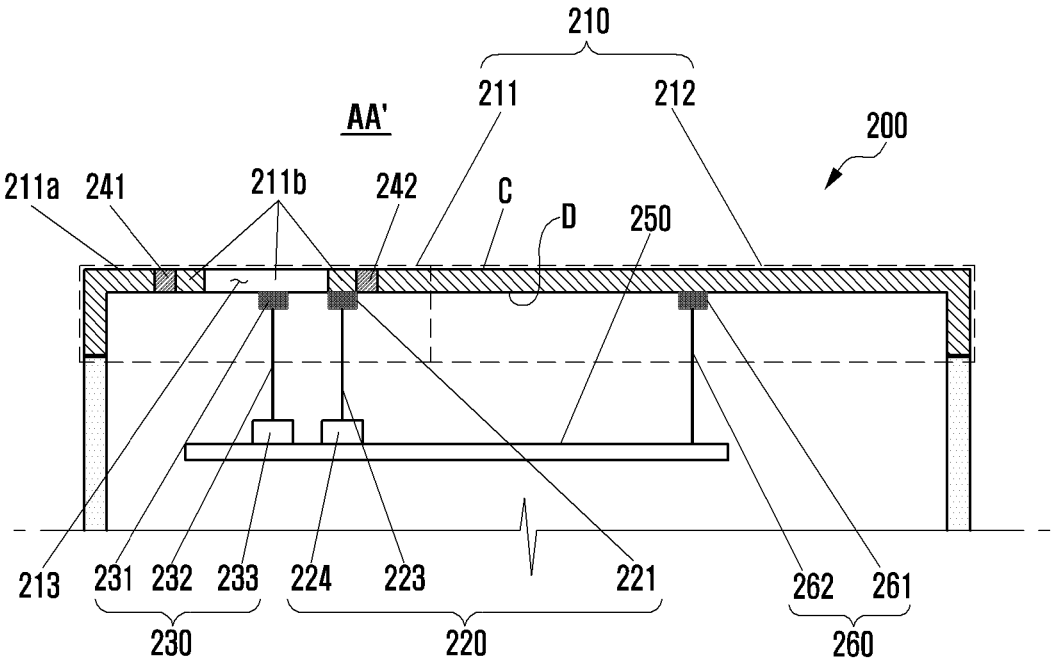
FIG. 2B is a sectional view of the antenna apparatus taken along line A-A' of FIG. 2A according to an embodiment of the present disclosure.
Figure 2C:
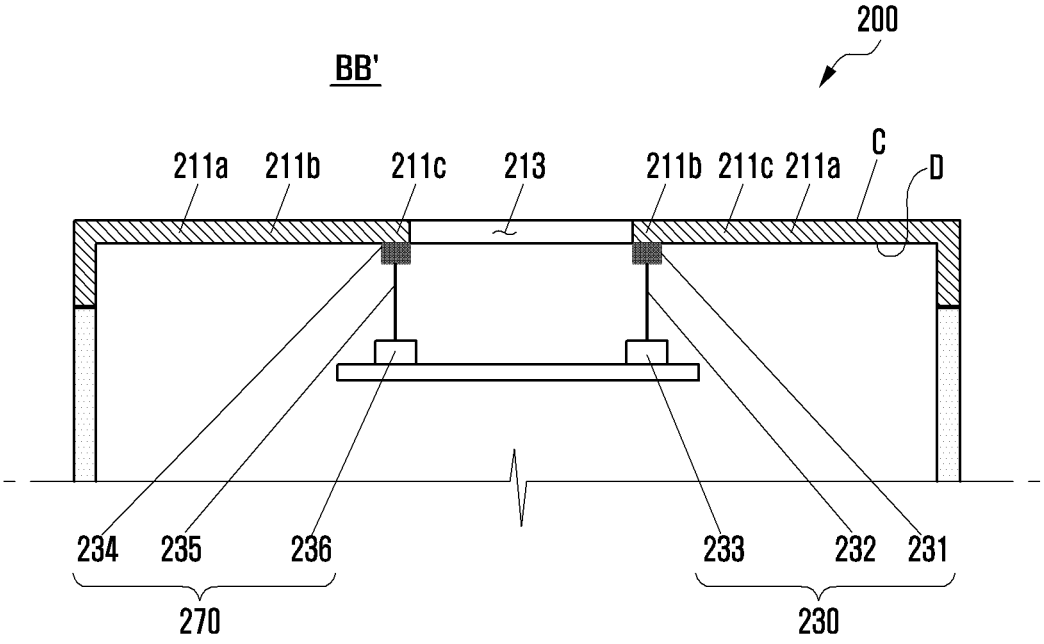
FIG. 2C is a sectional view of the antenna apparatus taken along line B-B' of FIG. 2A according to an embodiment of the present disclosure.
Figure 2D:
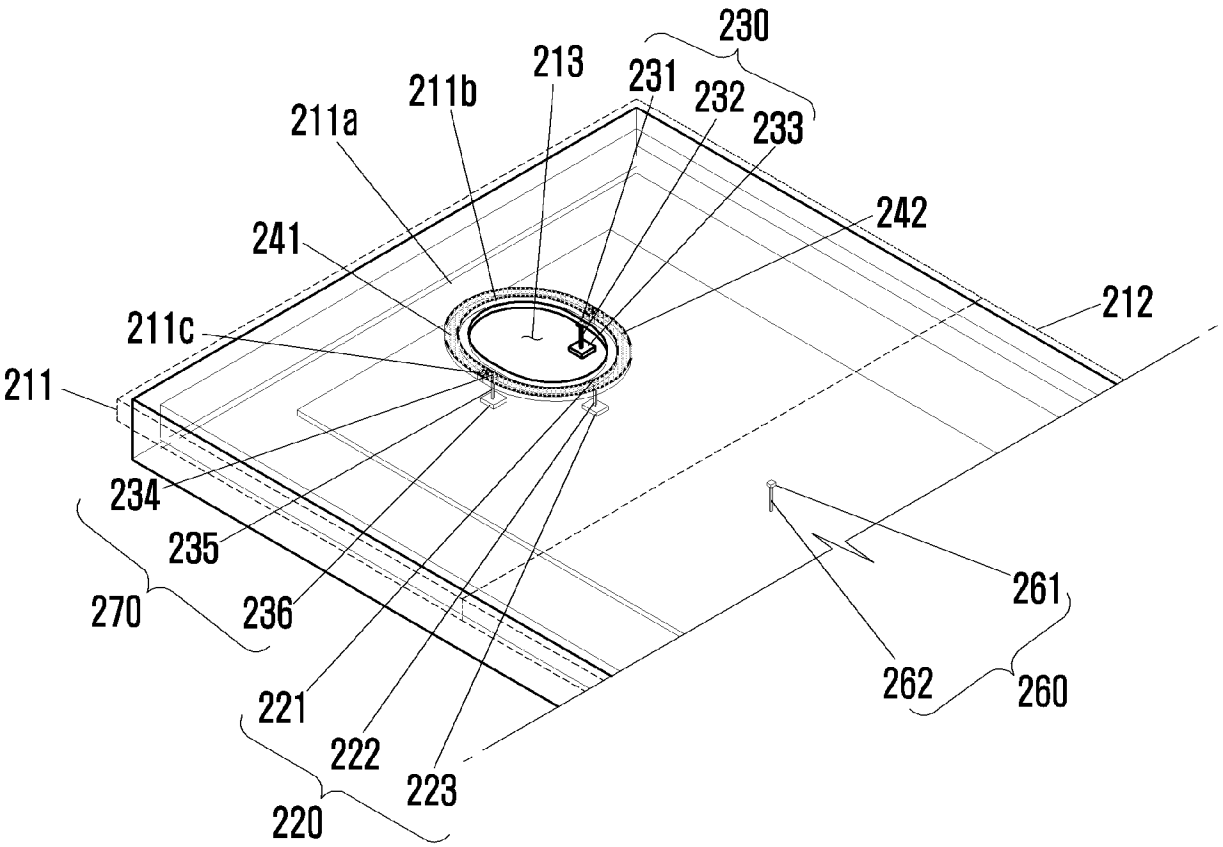
FIG. 2D is a perspective view of an antenna apparatus according to an embodiment of the present disclosure.

FIGS. 2A to 2D schematically show an antenna device 200 according to various embodiments of the present disclosure. FIG. 2A is a front view of an antenna apparatus 200 according to an embodiment of the present disclosure. FIG. 2B is a sectional view of the antenna device 200 taken along line A-A' of FIG. 2A according to an embodiment of the present disclosure. FIG. 2C is a sectional view of the antenna device 200 taken along line B-b' of FIG. 2A according to an embodiment of the present disclosure. FIG. 2D is a perspective view showing an internal configuration of a cover 210 of the antenna apparatus 200 according to an embodiment of the present disclosure.

The antenna apparatus 200 may include, for example, an entirety or a portion of the antennal apparatus 110 shown in FIG. 1. Referring to FIGS. 2A, 2B, and 2D, the antenna apparatus 200 may include a cover 210, a feeding module 220, a ground module 230, a first slit 241, and a second slit 242. According to an embodiment of the present disclosure, the antenna apparatus 200 may further include a substrate 250 which may provide an electrical signal to the antenna apparatus 200. The substrate is, for example, a ground conductor which may ground the antenna apparatus 200, and may be realized by using at least one of a Printed Circuit Board (PCB) and a Flexible Printed Circuit Board (FPCB).

According to an embodiment of the present disclosure, the cover 210 may include a conductive material (for example, a metal) in at least one area, and may be at least a portion of a case of the electronic device 100. For example, the cover 210 may form an entirety or a portion of one surface (for example, a rear surface) of the electronic device 100. For example, the cover 210 may be a battery cover of the electronic device 100.

The cover 210 may form, for example, at least a portion of the radiation module 111 shown in FIG. 1. The cover 210 may include, for example, a first area 211 and a second area 212. According to an embodiment of the present disclosure, the first area 211 may formed of a conductive material, and the second area 212 may be formed of a nonconductive material (for example, plastic) differently from the first area 211. According to an embodiment of the present disclosure, the cover 210 may be formed of one conductive material irrespective of the classification of the area.

Thus, because at least one of first area 211 and second area 212 uses the cover 210 formed of a conductive material, the cover 210 may be utilized as a radiation body of the electronic device without employing a separate radiation body. Referring to FIG. 2A, the first area 211 may include, for example, a first section 211*a*, a second section 211*b*, and a third section 211*c*. According to an embodiment of the present disclosure, the cover 210 may include at least one slit spaced apart from the outer edge of the cover 210 by a predetermined distance. The cover 210 may include, for example, a first slit 241 and a second slit 242. For example, the cover 210 may be classified into a first section 211*a* corresponding to an outside of the slit and a second section 211*b* corresponding to an inside of the slit through the first slit 241 and the second slit 242. The first section 211*a* and the second section 211*b* may be connected to each other through a third section 211*c*.

For example, the first section 211*a* may refer to an area of the cover 210 located at an outside of the first lit 241 and the second slit 242 (for example, at least one of which contacts an outer edge of the first slit 241 or the second slit 242). For example, the second section 211*b* may refer to another area of the cover 210 located at an inside of the first slit 241 and the second slit 242 (for example, at least one of which contacts an inner edge of the first slit 241 or the second slit 242). When the cover 210 is formed of a conductive material irrespective of the classification of the area, the first section 211*a* may include the remaining sections of the cover 210 other than an inner area of the slit (for example, the second section 211*b*). The first section 211*a* may be used, for example, as a case of the electronic device (for example, the electronic device 100).

Although not shown, for example, another hole, an antenna, or a component related to other component elements of an electronic device (for example, the electronic device 100) may be disposed in the first section 211*a*. The second section 211*b* may include, for example, a hole or an aperture in the interior thereof. A hole 213 may be formed such that other elements (for example, a camera, a sensor, a flash or a speaker) of an electronic device (for example, the electronic device 100) may be exposed to the outside.

According to an embodiment of the present disclosure, the hole 213 may be separated from one or more slits (for example, a first slit 241 or a second slit 242) by a predetermined distance. As the hole 213 is spaced apart from the one or more slits by a predetermined distance, a portion of the cover 210 (for example, at least an area of the second section 211*b*) may be formed between the hole 213 and the one or more slits to have a predetermined width in a predetermined form (for example, a circular or polygonal ring shape). For example, the second section 211*b* of the cover 210 may have a polygonal band shape surrounding an outer edge of the hole 213.

According to an embodiment of the present disclosure, electric power may be fed to the antenna apparatus 200 through a conductive area (for example, at least an area of the second section 211*b*) located between the hole 213 and the at least one slit (for example, the first slit 241 or the second slit 242). A current for feeding electric power to the antenna apparatus 200 may be supplied, for example, from a communication module (for example, the communication module 130).

According to an embodiment of the present disclosure, a current for supplying electric power to the antenna apparatus 200 may be supplied through a separate conductive component element included in an electronic device (for example, the electronic device 100) instead of a portion of the cover.

For example, when the first slit 241 and the second slit 242 are formed in a closed curve form, the conductive material of the cover 210 may not be included in the interior of the slit (for example, one slit formed in a closed curved form). In this case, for example, a conductive component (for example, a metal component) constituting at least a portion of another component element (for example, a camera) of the electronic device exposed through the hole 213 may form the second section 211*b*. The conductive component may be formed, for example to surround an outer edge of the other component element (for example, a camera). The conductive component of the other component element may be provided, for example, for decoration of the other component element. According to an embodiment of the present disclosure, electric power may be supplied to the antenna apparatus 200 through the conductive component exposed through the hole 213.

According to an embodiment of the present disclosure, two slits (for example, the first slit 241 and the second slit 242) may be disposed in the cover 210, for example, symmetrically. The first slit 241 and the second slit 242 may be disposed according to additional various embodiments in addition to the symmetrical disposition.

According to an embodiment of the present disclosure, an insulation member may be filled in at least one space of the at least one slit. The insulation member may be formed of a nonconductive material. The insulation member may include, for example, at least one of plastic, a resin, an adhesive, and a glass fiber. For example, the insulation member may be a dielectric substance. As a dielectric substance is selectively applied to the antenna apparatus 200 according to the embodiment of the present disclosure in consideration of permittivity, RF transmission/reception performance of the antenna apparatus 200 can be adjusted. The kind of the dielectric substance is not limited, and various kinds of dielectric substances may be selected in consideration of performance of an antenna.

According to an embodiment of the present disclosure, the first slit 241 and the second slit 242 may be filled with a first insulation member and a second insulation member, respectively. The first insulation member and the second insulation member may be formed of the same material or different materials. For example, the first insulation member and the second insulation member may be a dielectric substance.

The third section 211*c* may be, for example, a section physically or electrically connecting the first section 211*a* and the second section 211*b*. According to an embodiment of the present disclosure, the cover 210 may include one slit having a closed loop shape. The first slit 242 and the second slip 242 may be formed, for example, in one circle form instead of in a separated form as in FIG. 2A. In this case, the third section 211*c* may not be present.

Referring to FIG. 2B, the cover 210 may include a first surface C exposed to the outside, and a second surface D facing the first surface C and not being exposed to the outside. A feeding module 220 (for example, the feeding module 112) may include a feeding pin 221, a feeding wire 223, and an electrical circuit 224.

According to an embodiment of the present disclosure, the feeding pin 221 may be disposed on the second surface D. For example, the feeding pin 221 may be disposed in the second section 211*b*. A current for feeding electric power to the antenna apparatus 200 may be forwarded to the second section 211*b* through the feeding pin 221. The current supplied to the second section 211*b* may be coupled to the first section 211*a*, for example, via the first slit 241 or the second slit 242 to be emitted to an external space in the form of electromagnetic waves through the first section 211*a*. The transmission/reception distance or transmission/reception area of the antenna apparatus 200 may be determined based on at least the area of the first section 211*a*. The feeding wire 223 of the feeding module 220 may connect the substrate 250 (for example, a current supply module in the substrate 250 for supplying a current to the feeding pin 221) and the feeding pin 221.

The electrical circuit 224 may be disposed, for example, between the feeding pin 221 and a communication module (for example, a communication module 130). The electrical circuit 224 may be, for example, a passive element, an active element, a micro strip line, a strip line, an inter-digital structure, or a combination of two or more of them. The electrical circuit 224 may change impedance (for example, input impedance) corresponding to an antenna apparatus 200 (for example, the antenna device 110) according to characteristic values (for example, capacitance, inductance, or resistance).

For example, the passive element may include at least one of a capacitor, an inductor, and a resistor. The active element may include at least one of a diode, a Field Effect Transistor (FET), and a Bipolar Junction Transistor (BJT). The inter-digital structure may be at least one of a passive element and an active element which is realized by a chip or a package, and may be mounted to the substrate 250.

Referring to FIG. 2C, the antenna apparatus 200 may include, for example, two or more ground connection modules (for example, a first ground connection module 230 and a second ground connection module 270). The first and second ground connection modules 230 and 270 may be disposed, for example, in at least one of the first section 211*a* and the second section 211*b*. According to an embodiment of the present disclosure, the ground connection modules 230 and 270 may be disposed to be symmetrical to each other. According to an embodiment of the present disclosure, the first ground connection module 230 (for example, the ground connection module 113) may include a first ground pin 231, a first ground connection wire 232, and a first matching circuit 233. The second ground connection module 270 may include, for example, a second ground pin 234, a second ground connection wire 235, and a second matching circuit 236.

According to an embodiment of the present disclosure, the first ground pin 231 of the first ground connection module 230 may be disposed on the second surface D. A location where the first ground connection module 230 is connected to the cover 210 may be variously selected according to the kind and performance of the antenna or the kind of the network. For example, the first ground pin 231 may be disposed in the second section 211*b*.

According to an embodiment of the present disclosure, the first ground pin 231 may be disposed, for example, in the first section 211*a*. A location of the first ground pin 231 in the first section 211*a* may determine, for example, a flow of a current generated in the cover 210. For example, the first ground pin 231 may be disposed at a predetermined separation from an outer edge of the cover 210.

The first ground connection wire 232 of the first ground connection module 230 may connect the first ground pin 231 and the substrate 250. The second ground connection wire 232 may connect, for example, the second ground pin 232 and the substrate 250.

According to an embodiment of the present disclosure, the first matching circuit 233 of the first ground connection module 230 may be disposed between the first ground pin 231 and the substrate 250 to electrically connect the substrate 250 and the first ground pin 231. According to an embodiment of the present disclosure, the second matching circuit 236 may be disposed between the second ground pin 234 and the substrate 250 to electrically connect the substrate 250 and the second ground pin 234.

According to an embodiment of the present disclosure, the first matching circuit 233 or the second matching circuit 236 may be, for example, a passive element, an active element, a micro strip line, a strip line, an inter digital structure, or a combination of two or more of them. The first matching circuit 233 or the second matching circuit 236 may change impedance of the antenna apparatus 200 (for example, the antenna apparatus 110) according to characteristic values (for example, capacitance, inductance, or resistance). For example, the first matching circuit 233 may change (for example, generate or move) resonance frequency of the antenna apparatus 200.

According to an embodiment of the present disclosure, the first ground circuit 233 and the second joint circuit 236 may compensate for a physical dimension of the antenna by adjusting an electrical length of the antenna apparatus 200. According to an embodiment of the present disclosure, at least one of the component elements of the first ground connection module 230 may be omitted from the configuration of the first ground connection module 230. For example, at least one of the first ground pin 231, the first ground connection wire 232, and the first matching circuit 233 may be omitted from the configuration of the first ground connection module 230. Further, at least one of the second ground pin 234, the second ground connection wire 235, and the second matching circuit 236 may be omitted from the configuration of the second ground connection module.

Additionally or alternatively, the antenna apparatus 200 may include a third ground connection module 260 (hereinafter, referred to as "a third ground connection module" for convenience of description). Referring to FIG. 2B, for example, the third ground connection module 260 may include a ground pin 161 and a ground connection wire 162.

According to an embodiment of the present disclosure, the ground pin 261 of the third ground connection module 260 may be disposed at a site on the second surface D corresponding to the first area 211*a*. For example, the ground pin 261 may be disposed at a side spaced apart from the second section 211*b* by a predetermined distance. For example, the third ground connection module 260 may be disposed in the second section 211*b* (for example, at least an area of the third ground connection module 260 may contact the second section 211*b*) or may be disposed within a predetermined distance from the feeding module 220, and the third ground connection module 260 may be disposed at a relatively outer edge of the cover 210. According to an embodiment of the present disclosure, the ground pin 261 may be disposed in the second section 211*b* or the third section 211*c*.

The ground connection wire 262 of the third ground connection module 260 may connect the ground pin 261 and the substrate 250 (for example, a conductive layer in the PCB 120). According to an embodiment of the present disclosure, the third ground connection module 260 may include a plurality of ground pins and a plurality of ground connection wires corresponding to the plurality of ground pins. According to an embodiment of the present disclosure, the cover 210 (for example, the first area 211) may be electrically connected to the ground of the electronic device through a free space according to a design of the electronic device. Accordingly, the third ground connection module 260 may be omitted from the configuration of the antenna device 200.

Figure 3:
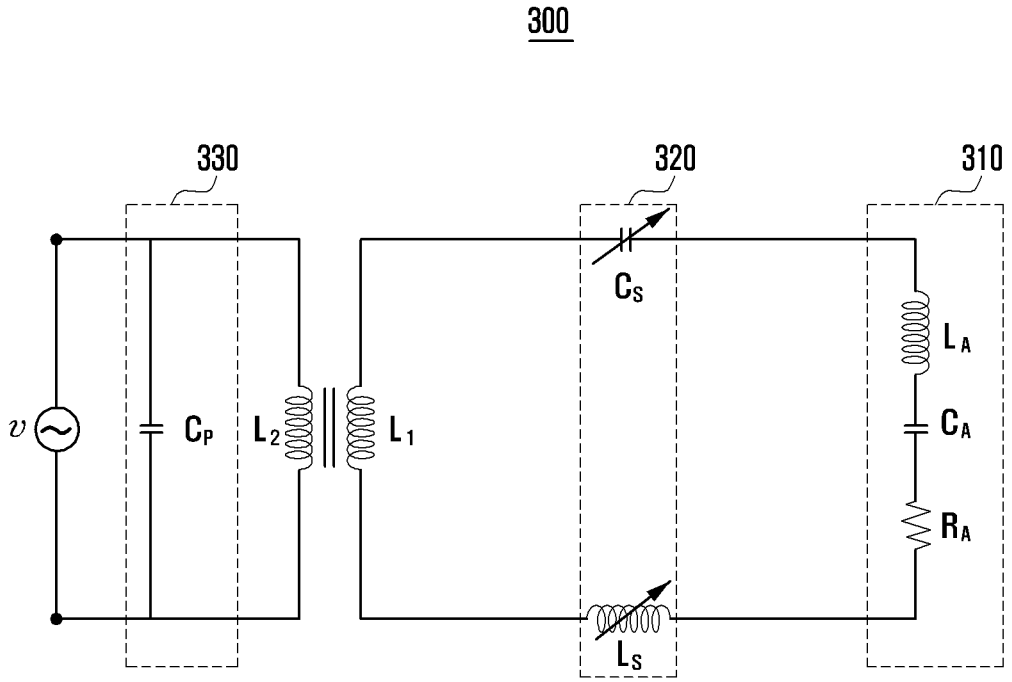
FIG. 3 is a circuit diagram of an equivalent circuit of an antenna apparatus according to an embodiment of the present disclosure.

FIG. 3 is an equivalent circuit of an antenna device according to an embodiment of the present disclosure.

Referring to FIG. 3, the antenna device (for example, the antenna device 200) may be expressed (for example, modeled) by an equivalent circuit 300 including, for example, a combination of a resistor R, an inductor L, and a capacitor C.

The radiation module (for example, the cover 210) of the equivalent circuit 300 may be modeled by a first equivalent circuit 310 including, for example, $L_A$, $C_A$, or $R_A$, or two or more combinations of them. For example, $L_A$, $C_A$, and $R_A$, may represent a physical length of the radiation module.

In the equivalent circuit 300, the ground connection module (for example, the ground connection module 230) may be modeled, for example, by the second equivalent circuit 320 including a combination of $C_S$ and $L_S$ connected to opposite ends of the first equivalent circuit 310. For example, $C_S$ and $L_S$ may correspond to the matching circuit (for example, the first matching circuit 233) of the ground connection module 230.

In the equivalent circuit 300, the feeding module (for example, the feeding module 220) may be modeled, for example, by a third equivalent circuit 330 connected to the second equivalent circuit 320. The third equivalent circuit 330 may include at least one $C_P$. For example, $C_P$ may correspond to an electrical circuit (for example, the electrical circuit 224) of the feeding module 220.

For example, the second equivalent circuit 320 may electrically compensate for a physical size (for example, a length) of a radiation module (for example, the radiation module 110).

The physical length of antenna device (for example, the antenna device 200) is determined according to a wavelength $$\left(\lambda = \frac{c}{f\sqrt{\varepsilon}}\right)$$

of electromagnetic waves for transmitting and receiving a signal in the antenna device. The resonance characteristic of the antenna device 200 may be associated with a physical length of the antenna device 200. The change in the length may cause a change ($f=1/(\sqrt{L_A C_A R_A})$) The electrical circuit (for example, $C_P$, $C_S$, and $L_S$) may compensate for a physical length of the antenna device 200 by increasing an electrical wavelength and varying (for example, lowering) input impedance. For example, the antenna device 200 may resonate against an RF signal of the corresponding frequency even if a physical length of the antenna device 200 is so short that an RF signal of the determined frequency cannot be transmitted and received.

According to an embodiment of the present disclosure, a cover (for example, the cover 210) of an antenna device (for example, the antenna device 200) may have various designs. For example, a location or form of a slit (for example, the first slit 241 or the second slit 242) of the cover may have various designs. The performance of the antenna device according to the design of the cover and the slit may be adjusted through an electrical circuit (for example, $C_P$, $C_S$, and $L_S$). The kind and values of the electrical circuit may be selected, for example, through experiments and simulations (for example, computer aided engineering).

Figure 4:
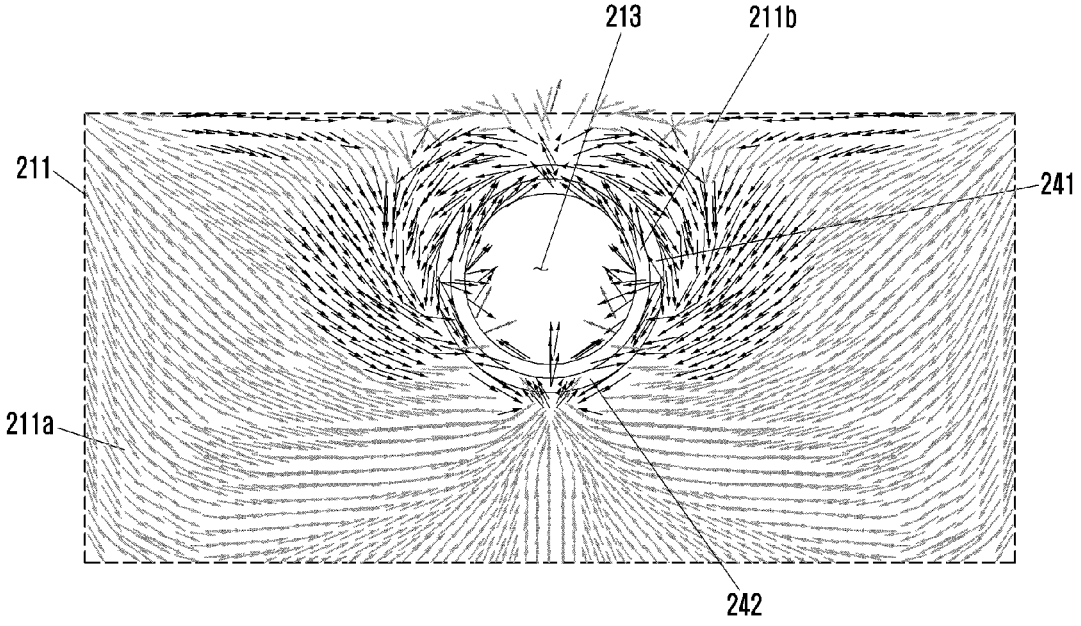
FIG. 4 schematically shows the flow of current in an antenna apparatus according to an embodiment of the present disclosure.

FIG. 4 is a view showing a flow of a current in an antenna apparatus according to an embodiment of the present disclosure.

If a current is supplied to the second section 211*b* of the antenna device (for example, the antenna device 200), a current may be coupled to the first section 211*a* through a slit (for example, the first slit 241 or the second slit 242). The current coupled to the first section 211*a* flows around a periphery of the slit and may flow over an area (for example, the first area 211) of a cover (for example, the cover 210). Accordingly, a magnetic field generated in the cover may be emitted to the outside of the cover.

The antenna apparatus may transmit and receive an RF signal of a predetermined frequency, for example, according to a design of a hole or a slit, a feeding module, or a ground connection module.

A strong magnetic flux is formed around a slit filled with an insulation member and a density of the electric flux is lowered as it goes toward the outside. Accordingly, a relatively large amount of electromagnetic waves may be radiated or induced around the slit.

Figure 5:
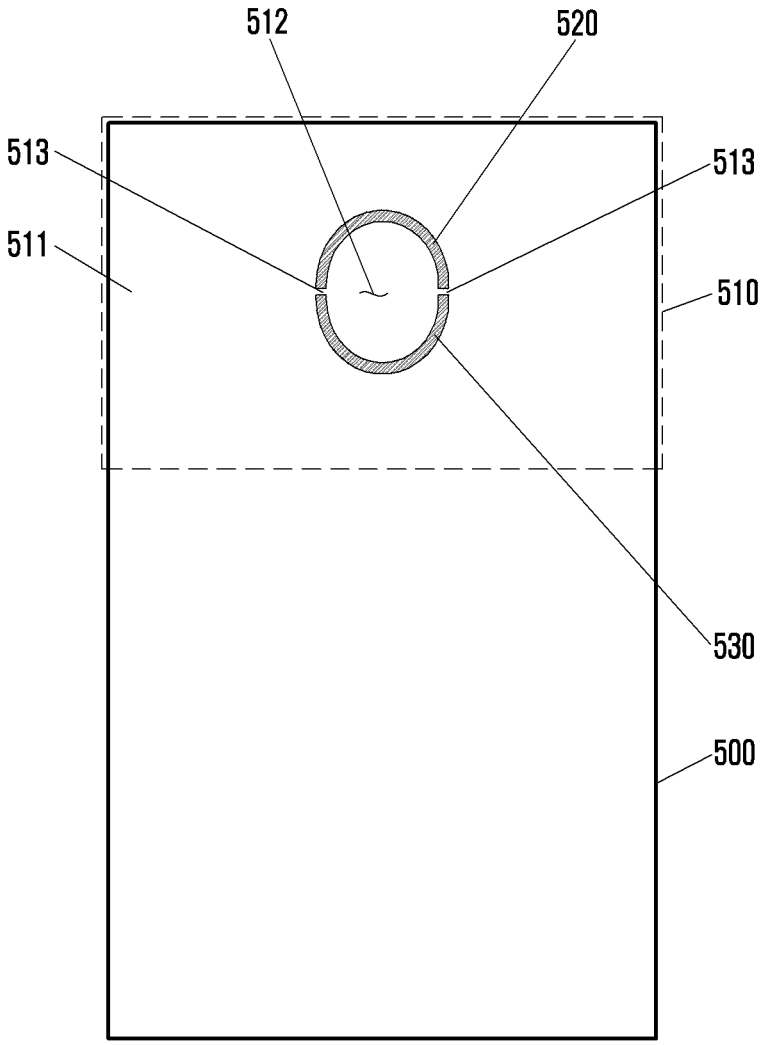
FIG. 5 is a front view schematically showing an antenna apparatus according to an embodiment of the present disclosure.

FIG. 5 is a front view schematically showing an antenna apparatus according to an embodiment of the present disclosure.

Referring to FIG. 5, for example, at least a portion 510 of the cover 500 in the antenna device (for example, the antenna device 200) may be formed of a conductive material. In an embodiment of the present disclosure, the entire cover 500 may be formed of a conductive material. For example, two slits may be formed in the interior of the portion 510. The slits may be disposed symmetrically. The portion 510 may be classified, for example, into a first section 511, a second section 512, and a third section 513 physically or electrically connecting the sections 511 and 512. The slits may be filled with the first insulation member 520 and the second insulation member 530. A hole may not be formed in the second section 512 differently from the cover 210 shown in FIGS. 2A to 2D.

Figure 6:
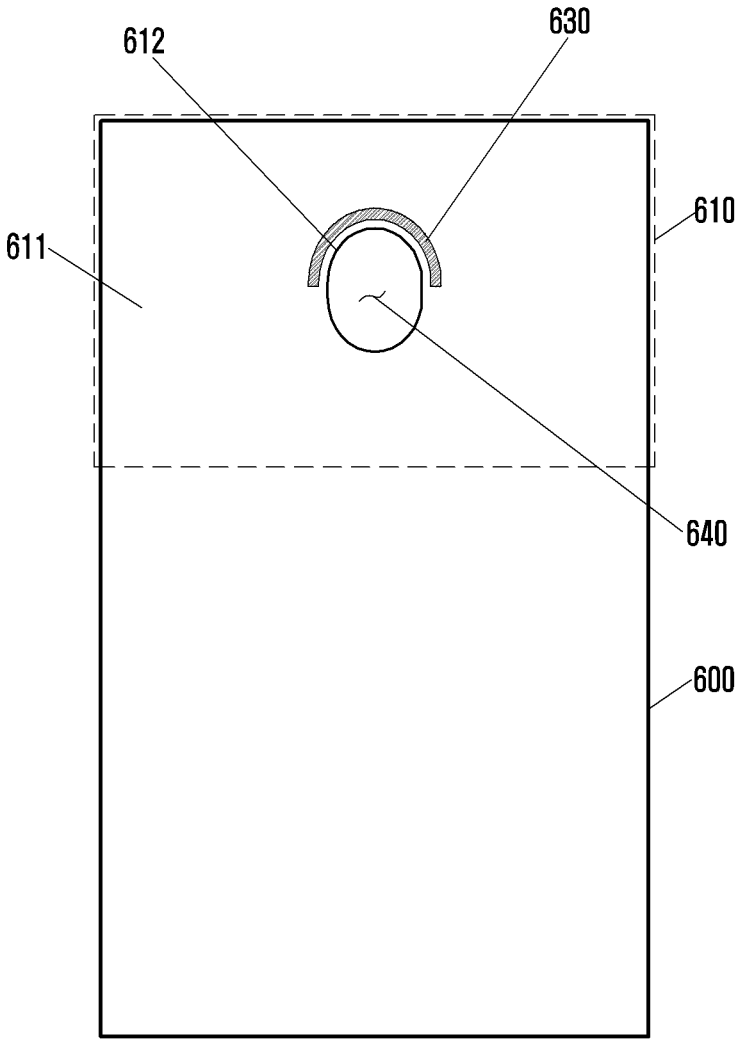
FIG. 6 is a front view schematically showing an antenna apparatus according to an embodiment of the present disclosure.

FIG. 6 is a front view schematically showing an antenna apparatus according to an embodiment of the present disclosure.

Referring to FIG. 6, for example, at least a portion 610 of the cover 600 in the antenna device (for example, the antenna device 200) may be formed of a conductive material. In an embodiment of the present disclosure, the entire cover 600 may be formed of a conductive material. One slit 630 may be formed in the interior of the portion 610 different from the cover 210 shown in FIGS. 2A to 2D. The portion 610 may be classified, for example, into a first section 611 and a second section 612 by the slit 630. In an embodiment of the present disclosure, the slit may be filled with an insulation member. According to an embodiment of the present disclosure, a hole 640 may be formed in an inner area of the slit 630 adjacent to the slit 630. The hole 640 may be a hole, for example, of a camera lens (for example, a lens 142), a flash (for example, a flash 144), or a speaker (for example, a speaker 151). In an embodiment of the present disclosure, the hole 640 may not be formed.

Figure 7:
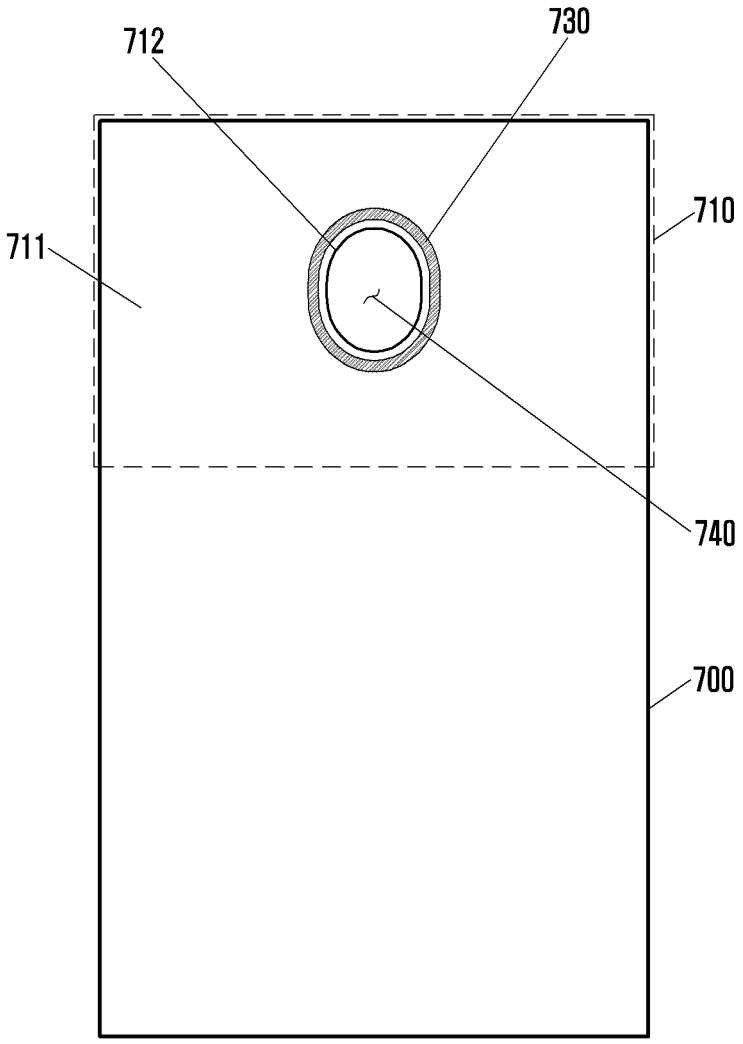
FIG. 7 is a front view schematically showing an antenna apparatus according to an embodiment of the present disclosure.

FIG. 7 is a front view schematically showing an antenna apparatus according to an embodiment of the present disclosure.

Referring to FIG. 7, for example, at least a portion 710 of the cover 700 in the antenna device (for example, the antenna device 200) may be formed of a conductive material. In an embodiment of the present disclosure, the entire cover 700 may be formed of a conductive material. One slit 730 may be formed in the interior of the portion 710 different from the cover 210 shown in FIGS. 2A to 2D. As shown, the slit 730 may be in the form of a closed curve. The portion 711 may be classified, for example, into a first section 711 and a second section 712 by the slit 710. In an embodiment of the present disclosure, the slit 730 may be filled with an insulation member. According to an embodiment of the present disclosure, a hole 740 may be formed in an inner area of the slit 730 adjacent to the slit. The hole 740 may be a hole, for example, for a camera lens (for example, a lens 142), a flash (for example, a flash 144), or a speaker (for example, a speaker 151). In an embodiment of the present disclosure, the hole 740 may not be formed.

Figure 8:
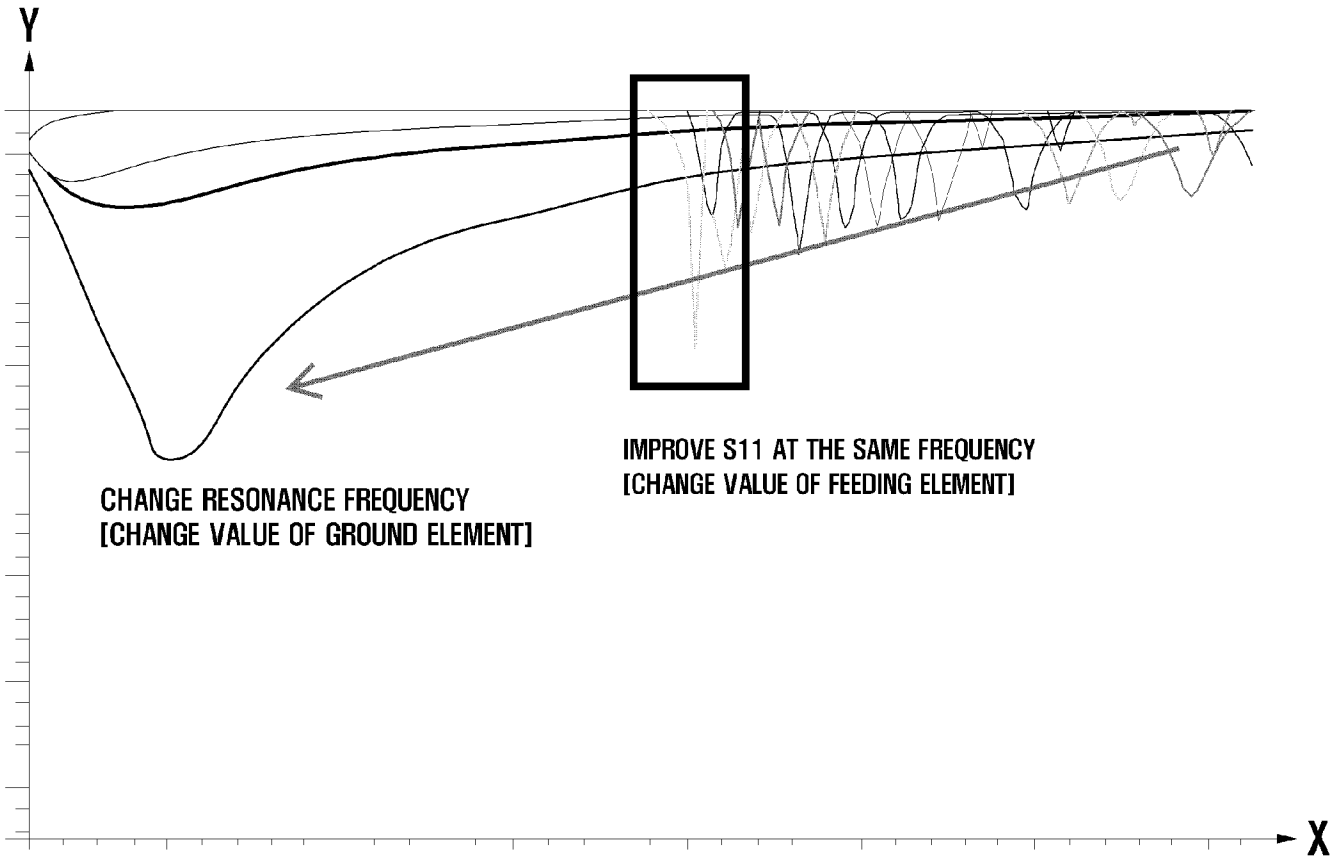
FIG. 8 is a graph schematically depicting a change in resonance frequency in an electronic device according to an embodiment of the present disclosure.

FIG. 8 is a graph schematically showing a change in resonance frequency in an electronic device according to various embodiments of the present disclosure. In the graph of FIG. 8, the X axis represents frequencies and the Y axis represents input reflective coefficients S11 (dB).

Referring to FIG. 8, if an element value (for example, $C_P$) of the feeding module 220 is changed in the electronic device 200, an input reflective coefficient S11 may be changed (for example, moved) while the resonance frequency remains the same. Accordingly, a radiation efficiency of the RF signal of the corresponding resonance frequency may be improved.

If an element value (for example, $C_S$ and $L_S$) of the ground connection module (for example, the first ground connection module 230) is changed in the electronic device 200, a resonance frequency may be changed. For example, an input reflective coefficient S11 may be changed. Accordingly, a radiation efficiency of the RF signal of the changed resonance frequency may be improved. Further, for example, the resonance sharpness (Q value) may be improved. Accordingly, a bandwidth of the frequency which can be dealt by the antenna 200 may be widened.

According to various embodiments of the present disclosure, the antenna device according to the present disclosure may be in the form of a flip cover.

According to an embodiment of the present disclosure, the antenna apparatus may include a first section including at least one slit spaced apart from an outer edge of the antenna apparatus by a predetermined distance; a second section distinguished from the first section through the slit, and a feeding module for supplying a current to at least one of the first section and the second section. The first section and the second section form at least a portion of the cover of the electronic device including the antenna apparatus, and the cover may include a conductive material in at least an area thereof. The at least one slit may surround at least a portion of the outer edge of the second section. A hole may be formed in the second section. The at least one slit may have a circular or polygonal shape surrounding the slit. At least a portion of the at least one slit may be filled with an insulation member. The filled insulation member of a plurality of insulation members, which differ in permittivity, is determined by a size of at least one of the first section, the second section, and the at least one slit. The feeding module may be connected to the second section. The antenna apparatus may further include a ground connection module for grounding at least one of the first section and the second section. The ground connection module may include a matching circuit, and at least one of the first section and the second section may be grounded through the matching circuit.

According to an embodiment of the present disclosure, An electronic device may include: a circuit board; and an antenna to which electric power is fed through the circuit board, and the antenna may include: a first section comprising a conductive material in at least one area and comprising a slit spaced apart from an outer edge of the electronic device by a predetermined distance; a second section distinguished from the first section through the slit; and a feeding module for supplying a current to at least one of the first section and the second section from the circuit board.

The electronic device may further include a ground connection module for grounding at least one of the first section and the second section. The ground module may include a ground pin disposed in the first section or the second section; a ground connection wire connecting the ground pin and a ground layer of the circuit board; and a matching circuit disposed between the ground connection wire and the ground layer.

At least a portion of at least one component included in the electronic device may be exposed to the outside of the electronic device through a hole formed in the second section.

The second section may be formed of a conductive component included in at least one of a component constituting the electronic device. The conductive component may surround at least a portion of an outer edge of the component and is exposed to the outside of the electronic device.

The first section and the second section may form at least a portion of a case formed on one surface of the electronic device. The circuit board may include a current supply module, and the feeding module may include: a feeding pin disposed in the second section; and a feeding wire connecting the feeding pin and the current supply module According to an embodiment of the present disclosure, an electronic device may include: a circuit board comprising a ground layer; a cover comprising a conductive material in at least one area and covering at least a portion of the circuit board; and an antenna apparatus configured by at least an area of the cover, and the antenna apparatus may include a first area at least a portion of which is surrounded by at least one slit spaced apart from an outer edge of the cover by a predetermined distance, a second area distinguished from the first area by the at least one slit, a feeding wire for supplying a current to the first area, and a ground connection wire for connecting the first area or the second area to the ground connection layer.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An antenna apparatus comprising:

a first section including at least one slit spaced apart from an outer edge of the antenna apparatus by a specified distance;

a second section distinguished from the first section through the at least one slit; and a feeding module for supplying a current to at least one of the first section and the second section, wherein a hole is formed in the second section, and wherein at least a portion of at least one component included in an electronic device including the antenna apparatus is exposed to the outside of the electronic device through the hole.

2. The antenna apparatus of claim 1, wherein the first section and the second section form at least a portion of a cover of the electronic device, and wherein the at least a portion of the cover includes a conductive material.

3. The apparatus of claim 1, wherein the at least one slit surrounds at least a part of the outer edge of the second section.

4. The antenna apparatus of claim 1, wherein the at least one slit is at least partially filled with an insulation member.

5. The antenna apparatus of claim 4, wherein the insulation member is determined from among a plurality of insulation members differing in permittivity based on a size of at least one of the first section, the second section, and the at least one slit.

6. The antenna apparatus of claim 1, wherein the feeding module is connected to the second section.

7. The antenna apparatus of claim 1, further comprising a ground connection module for connecting at least one of the first section and the second section to a ground.

8. The antenna apparatus of claim 7, wherein the ground connection module comprises:

a matching circuit, wherein at least one of the first section and the second section is grounded through the matching circuit.

9. An electronic device comprising:

a circuit board; and an antenna to which electric power is fed through the circuit board, wherein the antenna comprises:

a first section comprising a slit spaced apart from an outer edge of the electronic device by a specified distance;

a second section distinguished from the first section through the slit; and a feeding module for supplying a current to at least one of the first section and the second section from the circuit board, wherein at least a portion of the first section is formed of a conductive material, and wherein at least a portion of at least one component included in the electronic device is exposed to the outside of the electronic device through a hole formed in the second section.

10. The electronic device of claim 9, further comprising:

a ground connection module for connecting at least one of the first section and the second section to a ground.

11. The electronic device of claim 10, wherein the ground connection module comprises:

a ground pin disposed in the first section or the second section;

a ground connection wire connecting the ground pin to a ground layer of the circuit board; and a matching circuit disposed between the ground connection wire and the ground layer.

12. The electronic device of claim 9, wherein the at least one slit comprises a first slit and a second slit, and the first slit and the second slit surround at least a portion of an outer edge of the second section.

13. The electronic device of claim 9, wherein the second section is a conductive component included in at least a portion of a component forming the electronic device.

14. The electronic device of claim 13, wherein the conductive component surrounds at least a portion of an outer edge of the component and is exposed to the outside of the electronic device.

15. The electronic device of claim 9, wherein the first section and the second section form at least a portion of a case formed on one surface of the electronic device.

16. The electronic device of claim 9, wherein the circuit board comprises a current supply module, and the feeding module comprises:

a feeding pin disposed in the second section; and a feeding wire connecting the feeding pin and the current supply module.

17. The electronic device of claim 9, wherein at least a portion of the at least one slit is filled with an insulation member.

18. An electronic device comprising:

a circuit board comprising a ground layer;

a cover comprising a conductive material in at least one area and covering at least a portion of the circuit board; and an antenna apparatus configured by at least an area of the cover, wherein the antenna apparatus comprises:

a first area at least a portion of which is surrounded by at least one slit spaced apart from an outer edge of the cover by a predetermined distance, a second area distinguished from the first area by the at least one slit, a feeding wire for supplying a current to the first area, and a ground connection wire for connecting at least one of the first area and the second area to the ground layer, and wherein a hole is formed in the first area, and wherein at least a portion of at least one component included in the electronic device is exposed to the outside of the electronic device through the hole.

* * * * *